US007575454B1

(12) United States Patent
Aoki et al.

(10) Patent No.: US 7,575,454 B1
(45) Date of Patent: Aug. 18, 2009

(54) RECEPTACLE AND MOUNTING STRUCTURE THEREOF

(75) Inventors: Masayoshi Aoki, Tokyo (JP); Syouji Kawashima, Tokyo (JP); Yasunaga Mannen, Tokyo (JP); Katsuhito Tsujimura, Tokyo (JP)

(73) Assignee: Taiko Denki Co., Ltd., Tokyo (JP)

( * ) Notice: Subject to any disclaimer, the term of this patent is extended or adjusted under 35 U.S.C. 154(b) by 0 days.

(21) Appl. No.: 12/133,752

(22) Filed: Jun. 5, 2008

(51) Int. Cl.
*H01R 29/00* (2006.01)

(52) U.S. Cl. ..... 439/188; 439/676

(58) Field of Classification Search ..... 439/676, 439/188, 488–489, 607, 607.01, 944, 101, 439/108, 668, 63
See application file for complete search history.

(56) References Cited

U.S. PATENT DOCUMENTS 6,244,908 B1 * 6/2001 Hammond et al. ..... 439/676
6,296,492 B1 * 10/2001 Fujimoto et al. ..... 439/63
6,322,397 B1 * 11/2001 Zhang ..... 439/668
7,241,157 B2 * 7/2007 Zhuang et al. ..... 439/188

FOREIGN PATENT DOCUMENTS

JP 1140279 A 2/1999
JP 2006-329579 A 12/2006
JP 2007-103806 A 4/2007

* cited by examiner

*Primary Examiner*—Edwin A Leon
(74) *Attorney, Agent, or Firm*—McCormick, Paulding & Huber LLP

(57) ABSTRACT

A receptacle that can detect the insertion and extraction of a plug includes: a receptacle shell having formed therein a plug insertion port into which the plug is inserted and from which the plug is extracted; a receptacle body provided inside the receptacle shell; a movable contact that is installed at a base portion of the receptacle body, the base portion faces a distal end of the plug inserted into the plug insertion port, and that is deformed elastically when pushed by the plug; and an immovable contact that is installed at the base portion, is normally spaced from the movable contact, and comes into contact with the movable contact when the movable contact is pushed by the plug and elastically deformed. The receptacle that can conform to the HDMI standard can be realized without adding any modification to main components relating to mating with a plug.

7 Claims, 15 Drawing Sheets

RECEPTACLE AND MOUNTING STRUCTURE THEREOF

CROSS REFERENCE TO RELATED APPLICATIONS

Japanese Patent Applications Nos. 2006-329579 (filed on Dec. 6, 2006) and 2007-103806 (filed on Apr. 11, 2007) relate to the present application.

BACKGROUND OF THE INVENTION

1. Field of the Invention

The present invention relates to a receptacle capable of detecting the connection of a plug and to a mounting structure of the receptacle.

2. Description of the Related Art

Many receptacles have been prepared for connecting plugs of various external electronic devices such as analog video, digital video, various games, personal computers, and audio devices to newly produced TV sets. In this case, it is desirable that the TV set itself recognize the type of the external electronic device connected to the TV set. To meet this need, a connector has been suggested which can detect that the both plug and receptacle are electrically connected by inserting the plug into the receptacle.

As this suggestion, an invention is known (see Japanese Patent Application Laid-open No. 11-40279) that relates to a connector (c) comprising a receptacle (a) and a plug (b), as shown in FIG. 15, in which the receptacle (a) is provided with pairs of mutually opposite first and second switch pieces (d), (e) and third and fourth switch pieces (f), (g), the plug (b) is provided with protrusions (h), (i) for mutually contacting the switch pieces (e) and (d), and (g) and (f) when the receptacle (a) and the plug (b) are connected, the first switch piece (d) is connected to a connection monitoring circuit (j), the second switch piece (e) is connected to the third switch piece (g) by a line (k), and the fourth switch piece (f) is grounded.

In this invention, signals for judging connection and disconnection of the receptacle (a) and plug (b) can be detected by Transistor-Transistor Logic (TTL) as a High level when the plug (b) is disconnected and as a Low level when the plug is connected, and the connection-disconnection of the receptacle (a) and plug (b) can be judged by the signal level received by the connection monitoring circuit (j).

However, in the invention, the first to fourth switch pieces (d), (e), (f), (g) have to be provided at the receptacle (a), and the protrusions (h), (i) have to be provided at the plug (b) in order to detect connection-disconnection of the receptacle (a) and plug (b). Therefore, the presently available receptacles (a) and plugs (b) cannot be employed, unless they are significantly modified. In other words, the cost increase is substantial. Further, because the switch pieces (d), (e), (f), (g) are provided on both sides of the receptacle (a), and the protrusions (h), (i) are provided on both sides of the plug (b), the receptacle (a) and plug (b) are increased in width. Furthermore, because the four switch pieces (d), (e), (f), (g) have to be wired in series, the patterning thereof inevitably becomes complex.

Accordingly, the invention is inapplicable to receptacles and plugs whose shape is strictly determined by a standard, for example, receptacles and plugs conforming to the HDMI® (High Definition Multimedia Interface) standard.

SUMMARY OF THE INVENTION

The present invention was created with the foregoing in view and it is an object thereof to provide a receptacle capable of detecting that a plug is engaged to the receptacle and the both plug and receptacle are electrically connected, and also to provide a mounting structure of such receptacle. The present invention is applicable to receptacles and plugs whose shape is strictly determined by a standard, more specifically, to receptacles and plugs conforming to the HDMI standard, that is, the present invention involves absolutely no changes in the main components relating to the mating of the receptacle and plug and causes no loss of mounting ability of the receptacle.

The invention set forth in claim 1 that has been created to attain the above-described object provides a receptacle that can detect the insertion and extraction of a plug, comprising a receptacle shell having formed therein a plug insertion port into which the plug is inserted and from which the plug is extracted; a receptacle body provided inside the receptacle shell; a movable contact that is installed at a base portion of the receptacle body, said base portion faces a distal end of the plug when the plug is inserted into the plug insertion port, and that is deformed elastically when pushed by the plug; and an immovable contact that is installed at the base portion, is normally separated from the movable contact, and comes into contact with the movable contact when the movable contact is pushed by the plug and elastically deformed.

The invention set forth in claim 2 provides a receptacle that can detect the insertion and extraction of a plug, comprising: a receptacle shell having formed therein a plug insertion port into which the plug is inserted and from which the plug is extracted; a receptacle body provided inside the receptacle shell; a movable contact that is installed at a base portion of the receptacle body, said base portion faces a distal end of the plug when the plug is inserted into the plug insertion port, and that is deformed elastically when pushed by the plug; and an immovable contact that is installed at the base portion, is normally in contact with the movable contact, and separated from the movable contact when the movable contact is pushed by the plug and elastically deformed.

The invention set forth in claim 3 provides the receptacle according to claim 1 or 2, wherein the base portion having an accommodation portion which is formed in the base portion by hollowing in the base portion 71*a* in the insertion direction of the plug; and the movable contact and the immovable contact are installed in the accommodation portion.

The invention set forth in claim 4 provides a structure in which the receptacle according to any of claims 1 to 3 is mounted on a circuit board, wherein an electric circuit for detecting that the movable contact and the immovable contact are in contact with each or separated from each other is provided at the circuit board, and the electric circuit has an electric power line connected to one of the movable contact and the immovable contact, a ground line connected to the other of the movable contact and the immovable contact, and a detection line that is connected to the movable contact or the immovable contact and serves to detect a voltage.

The invention set forth in claim 5 provides a structure in which a receptacle that detects the insertion and extraction of a plug having a plug shell made of a metal is mounted on a circuit board, wherein the receptacle comprises: a receptacle shell made of a metal and having formed therein a plug insertion port into which the plug is inserted and from which the plug is extracted; a receptacle body provided inside the receptacle shell; an installation leg formed on the receptacle shell; a spring portion formed on the receptacle shell and coming into contact with the plug shell when the plug is inserted into the plug insertion port; and a detection contact that is installed at the receptacle body, insulated from the receptacle shell, has a lead portion that is conductively connected to the circuit board, and has a contact portion that comes into contact with the plug shell of the plug inserted into the plug insertion port, and the circuit board comprises: a conductor pattern for grounding to which the installation leg is soldered; an electric power line to which a lead portion of the detection contact is soldered; and a detection line that detects a variation of a voltage applied to the detection contact when the plug is inserted into the plug insertion port and electric conduction is established between the contact portion of the detection contact and the spring portion of the receptacle shell by the plug shell.

The invention set forth in claim 6 provides the mounting structure of the receptacle according to claim 5, wherein the receptacle body has a terminal table that is formed to extend toward the plug insertion port inside the receptacle shell, and the contact portion of the detection contact is disposed opposite the terminal table and formed to protrude further to the side of the terminal table from the inner surface of the receptacle shell.

The invention set forth in claim 7 provides mounting structure of the receptacle according to claim 5 or 6, wherein the receptacle shell is formed into a tubular shape by the engagement of a convex portion formed on one end of a metal sheet and a concave portion formed on the other end of the metal sheet, a cut-out portion is provided on an abutment line of the receptacle shell, the cut-out portion being positioned deeper in the plug insertion direction than the convex portion and the concave portion and being cut symmetrically with respect to the abutment line, and the contact portion of the detection contact is disposed inward of the cut-out portion, spaced from an inner edge of the cut-out portion.

DESCRIPTION OF THE PREFERRED EMBODIMENTS

"Receptacle and Mounting Structure Thereof" that are described in the present detailed description, claims, and drawings have been described in Japanese Patent Applications Nos. 2006-329579 and 2007-103806.

The preferred embodiments of the present invention are explained below with reference to the appended drawings. All the below-described embodiments illustrate the application of the present invention to a receptacle conforming to the above-descried HDMI standard.

An embodiment of the inventions set forth in claims 1 to 4 will be described below with reference to FIG. 1 to FIG. 6.

Figure 1:
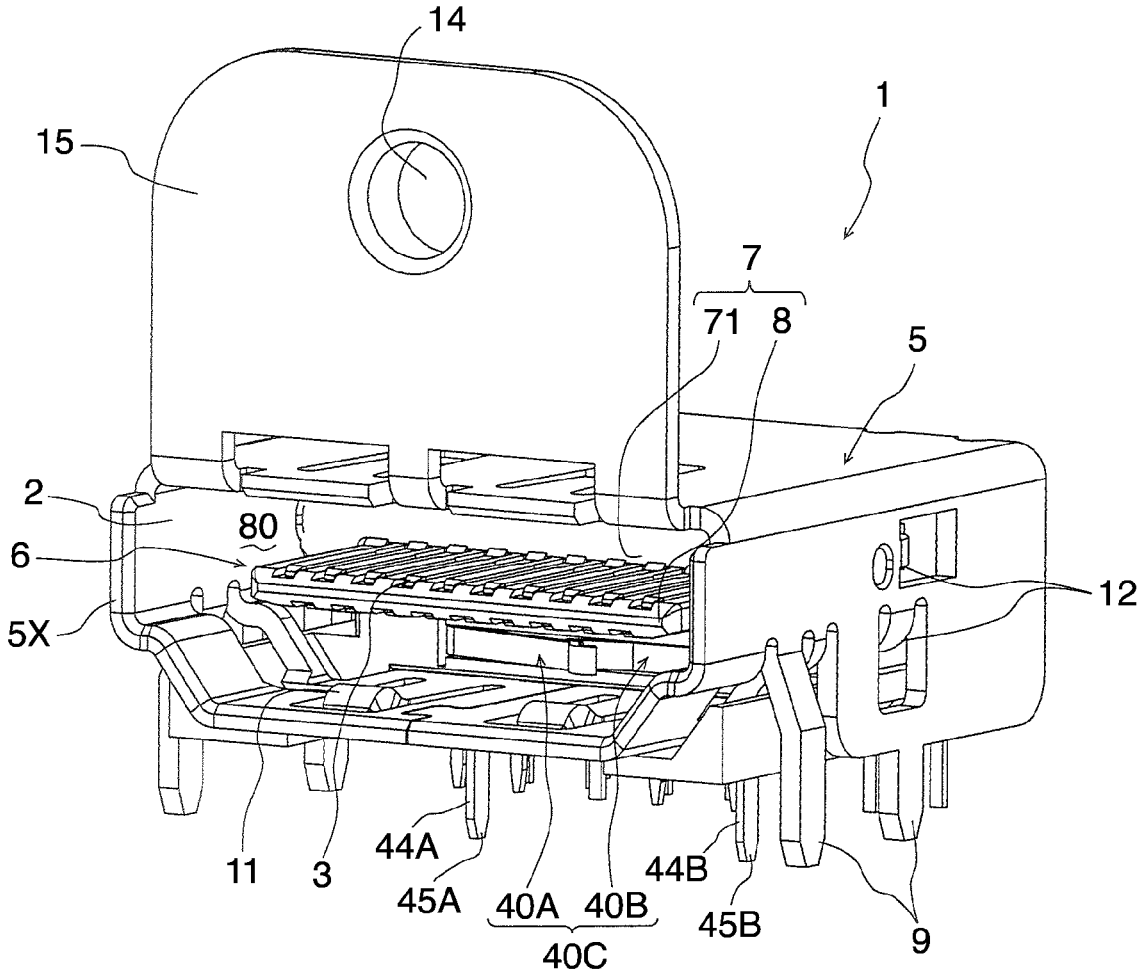
FIG. 1 is a perspective view of the receptacle illustrating an embodiment of the present invention.
Figure 2:
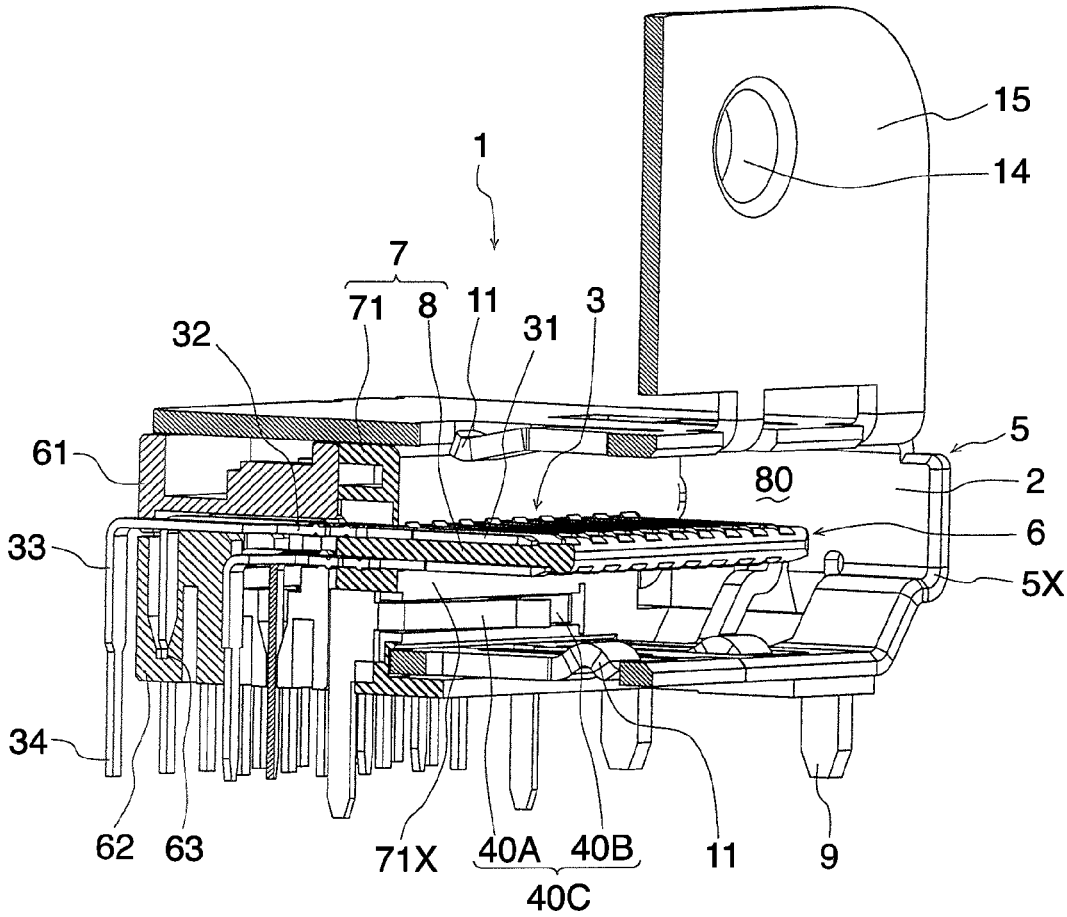
FIG. 2 is a perspective vertical sectional view of the receptacle shown in FIG. 1.

As shown in FIG. 1 and FIG. 2, a receptacle 1 is composed mainly of a receptacle shell 5 made of a sheet metal and in which a plug insertion port 2 for insertion-extraction of a plug (see FIG. 6) is formed, and a receptacle body 6 provided inside the shell 5. The receptacle 1 is installed, for example, inside a TV set.

The shell 5 has a tubular portion 5X, the plug insertion port 2 is open at one end of the tubular portion 5X, and the other end of the tubular portion 5X is closed by the body 6. A space 80 that can receive the plug is formed inside the tubular portion 5X. The plug that have been inserted through the port 2 from the left, as shown in FIG. 1, is received in the space 80.

The shell 5 has a spring portion 11 that elastically supports the plug received in the space 80, a flange 15 having formed therein an installation hole 14 for fixing the shell 5, that is, the receptacle 1, e.g. to a chassis of a TV set, a locking hook 12 for fixing the body 6 to the shell 5, and an installation leg 9 for fixing the shell 5 to a circuit board (not shown in the figure). Each of The spring portion 11, the flange 15, the locking hook 12 and the installation leg 9 is formed integrally with the shell 5, respectively. The installation leg 9 passes through an installation hole provided in the circuit board and is soldered to a GND pattern arranged on the backside of the board. The shell 5 is thereby grounded.

The body 6 comprises a molding portion 7 fixed inside the shell 5 and a plurality of terminals 3 arranged at the molding portion 7. The molding portion 7 has a base portion 71 that is fixed to the shell 5 by the locking hook 12 and a terminal table 8 in the form of a flat board extending from the base portion 71 in the direction toward the port 2. The terminals 3 are arranged and disposed on the backside and upper surfaces of the table 8.

Figure 3:
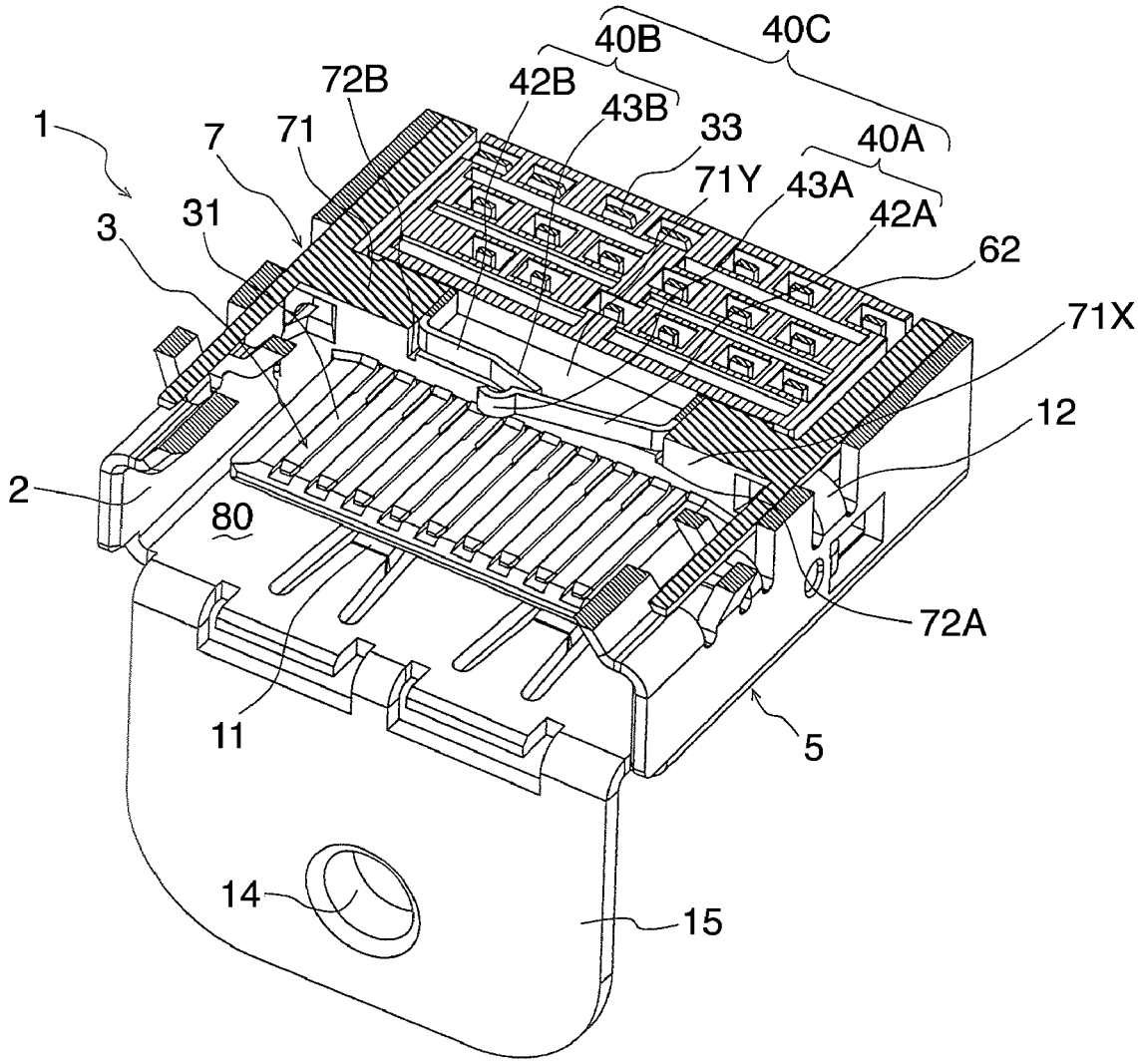
FIG. 3 is a perspective lateral sectional view from the bottom surface side of the receptacle shown in FIG. 1.
Figure 4:
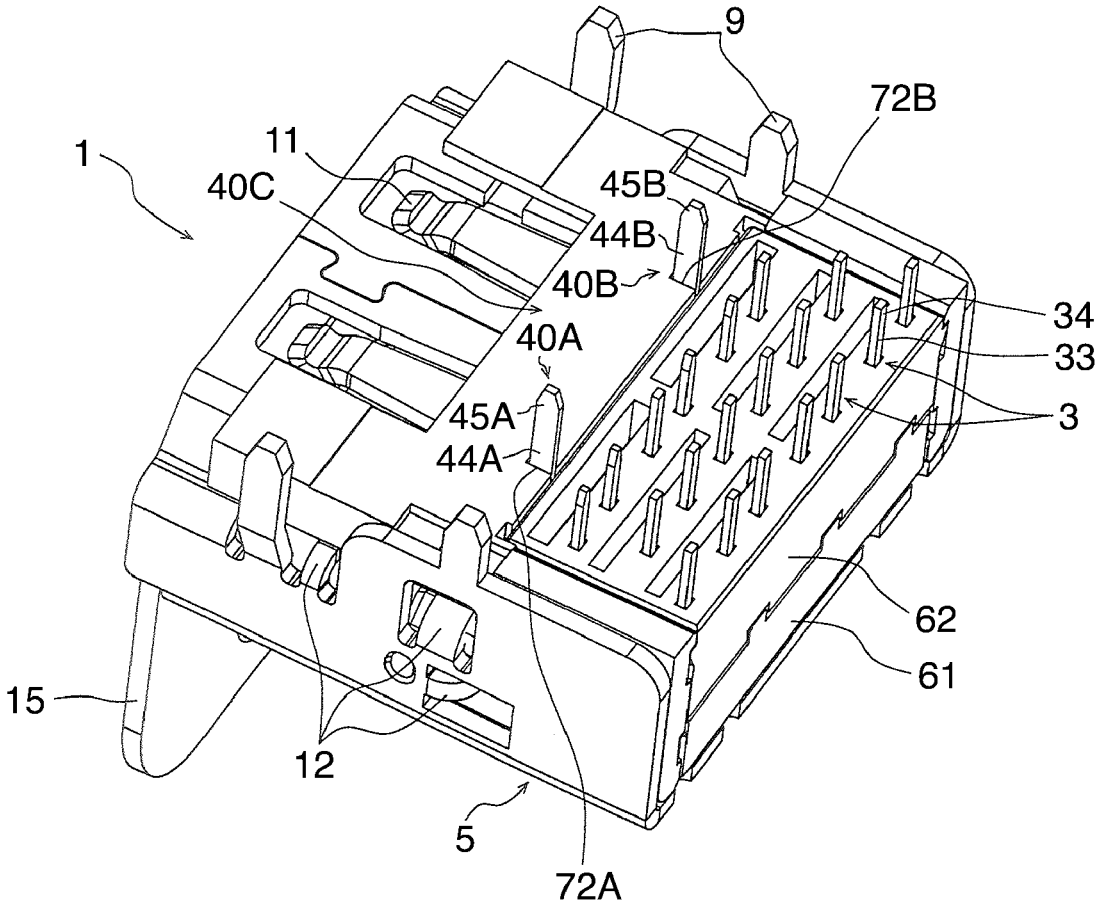
FIG. 4 is a perspective view from the bottom surface side of the receptacle shown in FIG. 1.
Figure 5:
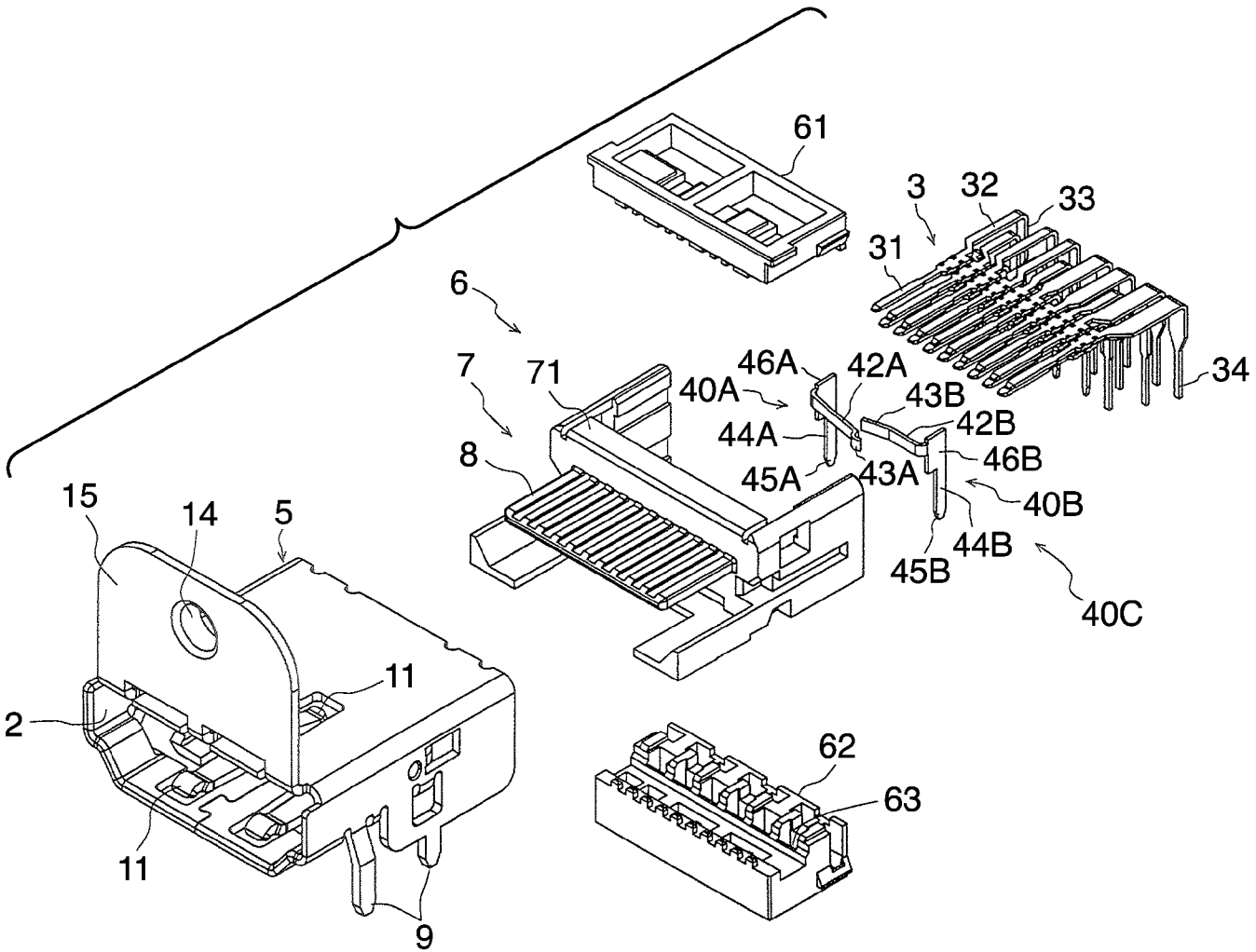
FIG. 5 is an exploded view of the receptacle shown in FIG. 1.

Each terminal 3 is composed of a contact portion 31 that is positioned on the table 8, an arm portion 32 that extends from the contact portion 31 through the base portion 71, a leg portion 33 that extends at a right angle from the arm portion 32, and a lead portion 34 that is provided on the distal end of the leg portion 33 and is soldered to a conductor pattern provided on the circuit board (see FIG. 3, FIG. 4, and FIG. 5).

In the receptacle 1 of the present embodiment conforming to the HDMI standard, a total of nineteen terminals 3 are provided (ten terminals on the upper surface and nine terminals on the backside of the terminal table 8); GND terminals, signal terminals, and power terminals of terminals 3 are arranged in a predetermined order and with a predetermined pitch. The GND terminals are soldered to the GND pattern of the circuit board, the signal terminals are soldered to a signal conductor pattern of the circuit board, and the power terminals are soldered to a power source pattern of the circuit board. In the receptacle 1 conforming to the HDMI standard, the shape and dimensions of the portions related to insertion of the plug, such as the plug insertion port 2, are also determined by this standard.

As shown in FIG. 2 and FIG. 5, an upper block 61 and a lower block 62 made of a resin are attached to the receptacle body 6 to support the terminals 3. In the terminals 3, the leg portions 33 are inserted into and supported by support holes 63 formed in the lower block 62, and the arm portions 32 are supported by the backside of the upper block 61.

As shown in FIG. 3, a switch 40C for detecting insertion-extraction of the plug is provided in the receptacle 1. The switch 40C is two lever type switch and has a movable contact 40A and an immovable contact 40B. The switch 40C is of a normally open contact system. In this system the movable contact 40A is normally spaced from the immovable contact 40B. When the plug is inserted, the movable contact 40A is pushed and bent by the top end of the plug so that the movable contact 40A contacts with the immovable contact 40B and the switch 40C is conductive.

The switch 40C is installed in a accommodation portion 71Y that is formed as a concave in the base portion 71. More specifically, the accommodation portion 71Y is a space formed in the shape of a rectangular parallelepiped. The accommodation portion 71Y extends in the insert direction of the plug from a vertical surface 71X of the base portion 71 against which the top end of the plug that is being inserted can abut. The both contacts 40A, 40B are positioned in the accommodation portion 71Y.

As shown in FIG. 3 and FIG. 5, the movable contact 40A comprises a wide fixing portion 46A that is forcedly inserted into an insertion hole 72A formed in the end portion in the width direction of the accommodation portion 71Y, an arm portion 42A extending from the portion 46A in the width direction of the receptacle 1, a contact portion 43A provided at the distal end of the arm portion 42A, a leg portion 44A extending from the fixing portion 46A in the thickness direction of the receptacle 1, and a lead portion 45A that is provided at the distal end of the leg portion 44A and extending through an installation hole provided in the circuit board and soldered to a conductor pattern PS (see FIG. 6) provided at the backside of the circuit board. The conductor pattern PS is connected to a power source line X of the circuit board.

The immovable contact 40B comprises a wide fixing portion 46B that is forcedly inserted into an insertion hole 72B formed in the end portion in the width direction of the accommodation portion 71Y, an arm portion 42B extending from the portion 46B in the width direction of the receptacle 1, a contact portion 43B provided at the distal end of the arm portion 42B, a leg portion 44B extending from the fixing portion 46B in the thickness direction of the receptacle 1, and a lead portion 45B provided at the distal end of the leg portion 44B and passing through an installation hole provided in the circuit board and soldered to a conductor pattern PF (see FIG. 6) provided at the backside of the circuit board. The conductor pattern PF is connected to a GND pattern PG of the circuit board via a ground line Z provided at the board.

The both fixing portions 46A and 46B are press fitted into respective insertion holes 72A and 72B that are formed at a distance from each other at both ends of the accommodation portion 71Y. The arm portions 42A and 42B are extending and arranged parallel to each other. Further, the contact portion 43A of the movable contact 40A is positioned in front of the contact portion 43B of the immovable contact 40B. The contact portion 43A protrudes forward, in a free state thereof, from the vertical surface 71X.

Where the plug is completely inserted into the space 80, the contact portion 43A of the movable contact 40A is pushed by the top end of the plug, and the arm portion 42A is elastically deformed in the plug insertion direction and brought into contact with the contact portion 43B of the immovable contact 40B. At this time, the arm portions 42A, 42B and contact portions 43A, 43B are accommodated inside the accommodation portion 71Y and do not prevent the top end of the plug from being adequately abutted against the vertical surface 71X. Therefore, the plug is prevented from being inserted incompletely.

The above-described configuration is not limiting, provided that the movable contact 40A and the immovable contact 40B are pushed by the inserted plug and brought into contact with each other. For example, the insertion holes 72A and 72B may be disposed together at one side of the accommodation portion 71Y, and the arm portions 42A and 42B may be caused to extend in the same direction.

In the circuit board onto which the above-described receptacle 1 is mounted, an electric circuit C1 (see FIG. 6) is provided to detect that the movable contact 40A has come into contact with the immovable contact 40B.

Figure 6:
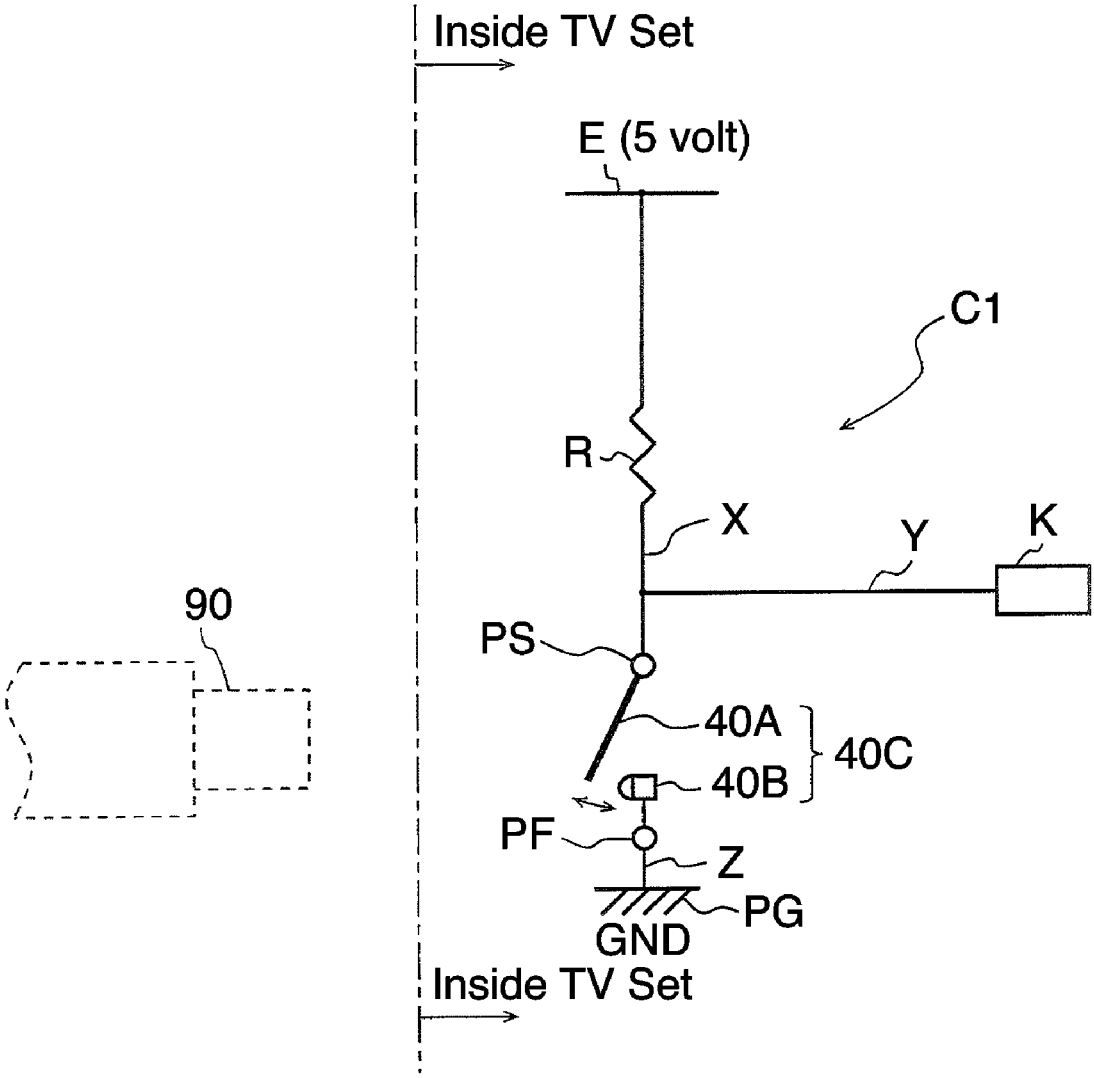
FIG. 6 serves to explain the mounting structure of the receptacle shown in FIG. 1, this being a schematic drawing of an electric circuit provided at the circuit board for detecting whether the plug has been mated with the receptacle.

As shown in FIG. 6, the electric circuit C1 is accommodated inside a device such as a TV set. The electric circuit C1 has the electric power line X that and connected to the conductor pattern PS to which the movable contact 40A is soldered, the ground line Z connected to the conductor pattern PF to which the immovable contact 40B is soldered, and a detection line Y that detects that the voltage applied to the movable contact 40A changes from high to low due to the connection of the power source line X and the ground line Z when the both contacts 40A, 40B come into contact with each other. The ground line Z is connected to the GND pattern PG of the circuit board.

In FIG. 6, the reference symbol E stands for a power source (5 V) connected to the power source line X, PS—the conductor pattern that is provided at the power source line X and to which the lead portion 45A of the movable contact 40A is soldered, R—a resistor for applying a voltage of the power source E to the movable contact 40A, PF—the conductor pattern that is provided at the ground line Z and to which the lead portion 45B of the immovable contact 40B is soldered, 40C—the switch of a two lever system that is composed of the movable contact 40A and the immovable contact 40B, and K—a detector for detecting the voltage in the detection line Y.

In the configuration reversed with respect to that shown in FIG. 6, the immovable contact 40B may be connected to the conductor pattern PS of the power source line X, and the movable contact 40A may be connected to the conductor pattern PF of the ground line Z.

The operation of the present embodiment will be described below.

In a state in which the plug 90 shown in FIG. 6 is not inserted into the receptacle 1, the both contacts 40A and 40B are separated from each other. Therefore, a High signal corresponding to the voltage (5 V) of the power source E passes through the detection line Y. Therefore, the detector K detects the High signal.

Where the plug 90 is inserted into the receptacle 1 and the movable contact 40A is pushed and bent by the plug 90, the movable contact 40A is contact with the immovable contact 40B. As a result, the voltage of the power source E that has been applied to the movable contact 40A is grounded to the ground line Z via the immovable contact 40B, and the signal in the detection line Y is switched from High to Low (almost 0 V). As a result, by detecting this variation of voltage with the detector K, it is possible to judge that the plug 90 and receptacle 1 are mated together.

As described hereinabove, the modification implemented in the receptacle 1 in accordance with the present invention is in that the accommodation portion 71Y is formed in the base portion 71 of the molding portion 7 and that the both contacts 40A, 40B are disposed in the accommodation portion 71Y, whereas the shell 5, the plug insertion port 2, the space 80, the terminal table 8, and the terminals 3 require absolutely no changes and are, therefore, fully compatible with the restrictive conditions of the HDMI standard. As a result, it goes without saying that the conventional receptacles can be used as the receptacle 1 in accordance with the present invention and that the plug 90 can be carried over, thereby preventing any cost increase.

Further, as described above, because the accommodation portion 71Y is formed in the base portion 71 which is positioned in the deepest location of the space 80 and the both contacts 40A, 40B are disposed therein, the effect produced thereby on the insertion depth of the plug 90 is zero and shallow insertion of the plug can be completely prevented.

In addition, even when the accommodation portion 71Y is to be formed in the already existing modeling portion 71, only slight modification of the molding die for the molding portion 71 is sufficient and the production cost can be reduced.

Further, in case of a receptacle which does not need to detect the connection with the plug 90, it will suffice not to incorporate the both contacts 40A, 40B into the receptacle 1, and such two kind of receptacles with different specifications can be compatible.

Because the shell 5 requires no modification, the rigidity, installation strength, and ability to prevent electromagnetic interference are not lost.

Because the both contacts 40A, 40B are disposed in the accommodation portion 71Y which is formed in the dead space of the base portion 71 as shown in FIG. 3, the receptacle 1 is not increased in size and mounting ability thereof is not lost.

As shown in FIG. 6, the modification of the circuit board involves only the application of a voltage of the power source E to the movable contact 40A and grounding of the immovable contact 40B with the object of detecting the mating of the plug 90 and the receptacle 1. Therefore, it is sufficient to provide additionally the circuit board only with the power line X that is connected by one end to the power source E and by the other end to the movable contact 40A and is provided with the resistance R, the detection line Y connected to the line X, the detector K connected to the detection line Y, the conductor pattern PS provided at the power source line X and on which the movable contact 40A is soldered, the conductor pattern PF on which the immovable contact 40B is soldered, and the ground line Z that is connected by one end thereof to the conductor pattern PF and by the other end to the GND pattern PG of the circuit board, and this addition can be made at a low cost. The power source E and GND pattern PG are provided on the original circuit substrate.

As shown in FIG. 4, the leg portions 44A, 44B of the contacts 40A, 40B, respectively, are provided almost parallel to the leg portions 33 of the terminals 3 and are spaced from the leg portions 33. Therefore, excess conductor patterning of the circuit board is not required and no bridging occurs during soldering to the circuit board. As a result, mounting operability of the receptacle 1 onto the circuit board is not lost.

Further, by dividing the switch 40C designed for detecting the mating of the plug 90 and the receptacle 1 into two switches for the movable contact 40A and the immovable contact 40B, it is possible to solder the respective lead portions 45A, 45B to the circuit board and increase the installation strength of the entire receptacle 1 to the board. The reason is that soldering points of receptacle 1 are increased by soldering both the lead portions 45A and 45B to the board.

The present invention is not limited to the above-described embodiment.

As mentioned above, the switch 40C of the present embodiment is a normally-open contact type, but such configuration is not limiting.

Thus, the switch 40C may be of a normally-closed contact type in which the movable contact 40A is in contact with the immovable contact 40B when the plug 90 is not inserted into the plug insertion port 2, but when the plug 90 is inserted into the plug insertion port 2, the movable contact 40A comes into contact with the plug 90 and is elastically deformed by the plug 90, whereby the movable contact 40A is withdrawn from the immovable contact 40B. In this case, the voltage of the detection line Y shown in FIG. 6 changes from low (0 V) to high (5 V), and the insertion of the plug 90 into the receptacle 1 can be sensed by detecting this change in the voltage with the detector K.

Further, the detection line Y may be also connected to the ground line Z, instead of the power source line X. In this case, the variation of voltage detected by the detector K as the plug 90 is inserted into the receptacle 1 and removed therefrom is reversed with respect to that of the above-described embodiment.

In the present embodiment, it is described that when the plug 90 is inserted into the receptacle 1, the top end of the plug 90 abuts against the base portion 71 (vertical surface 71X) of the molding portion 7 of the receptacle 1, but a configuration without such abutment is also possible. The present invention also covers a configuration in which the top end of the inserted plug 90 abuts against the movable contact 40A and the movable contact 40A is elastically deformed.

Further, in the present embodiment, a case is explained in which the both contacts 40A, 40B are forcedly inserted into the insertion holes 72A, 72B, respectively, but such configuration is not limiting. For example, after the both contacts 40A, 40B have been insertion molded in a separate insulation part, the parts may be incorporated in the molding portion 7.

Although the contact 40B is named "immovable contact", the contact 40B may not require the immovability in a strict meaning, and it may move slightly with the movement of the contact 40A.

The embodiment of the inventions set forth in claims 5 to 7 will be described below with reference to FIG. 7 to FIG. 14.

In the present embodiment, one detection contact 140 is provided in place of the switch 40C of the above-described embodiment explained with reference to FIG. 1 to FIG. 6. Other basic structural features of the receptacle are identical in the two embodiments. Accordingly, the components identical to those of the above-described embodiment will be assigned with identical reference symbols and explanation thereof will be omitted, and only the differences between the two embodiments will be explained. Similarly to the receptacle 1 of the above-described embodiment, the receptacle 1 of the present embodiment also conforms to the HDMI standard.

Figure 7:
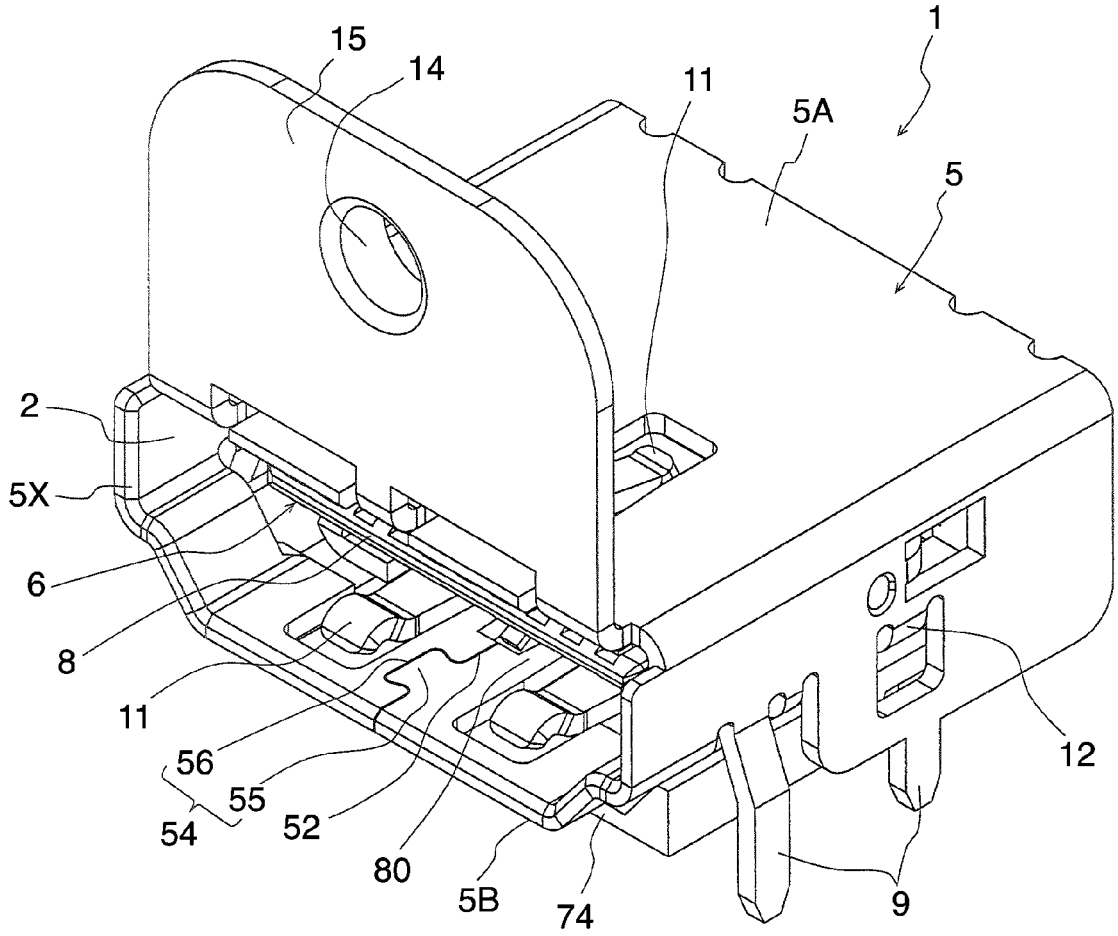
FIG. 7 is a perspective view of the receptacle used in the mounting structure of the receptacle illustrating another embodiment of the present invention.
Figure 8:
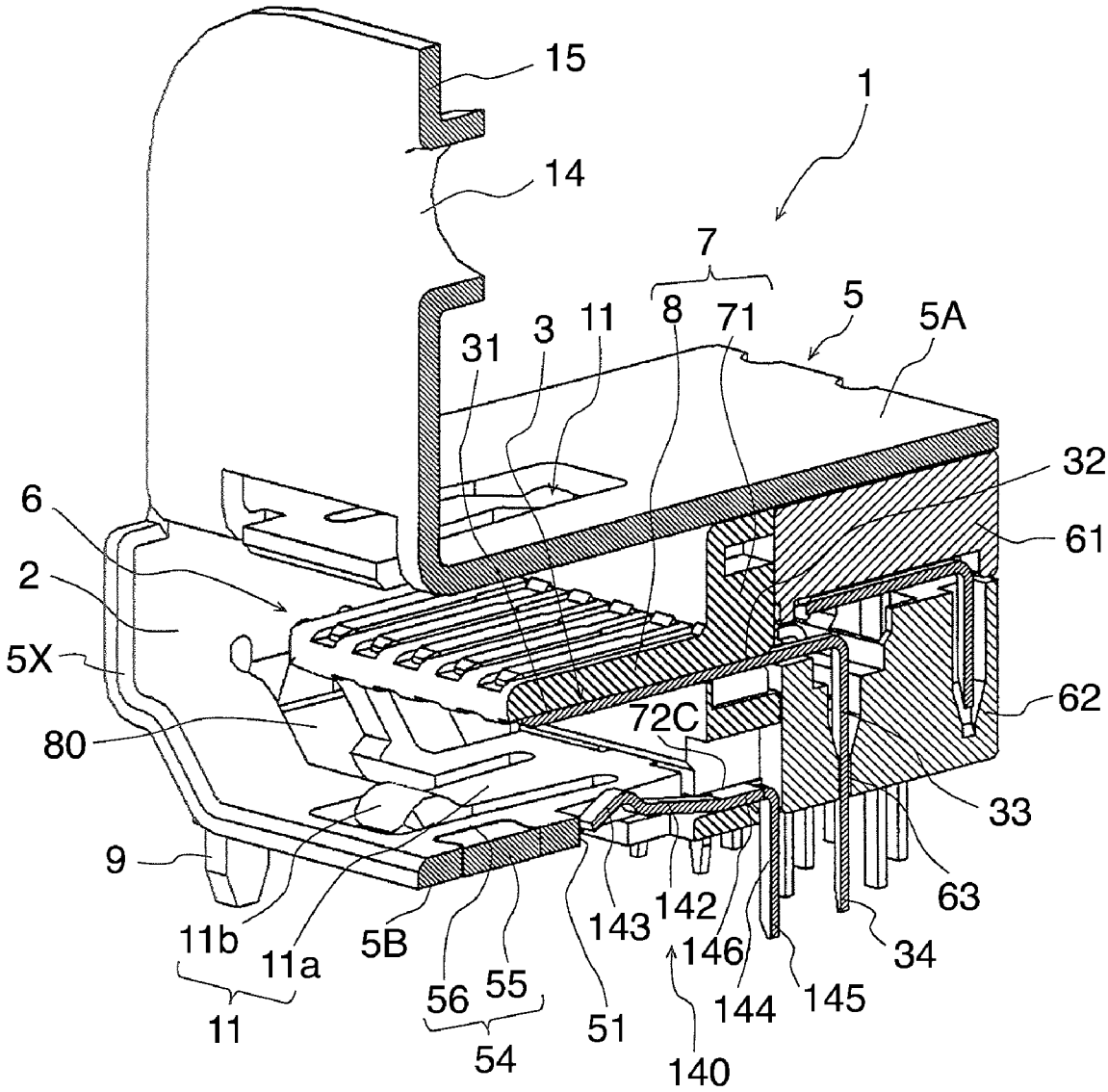
FIG. 8 is a perspective vertical sectional view of the receptacle shown in FIG. 7.
Figure 9:
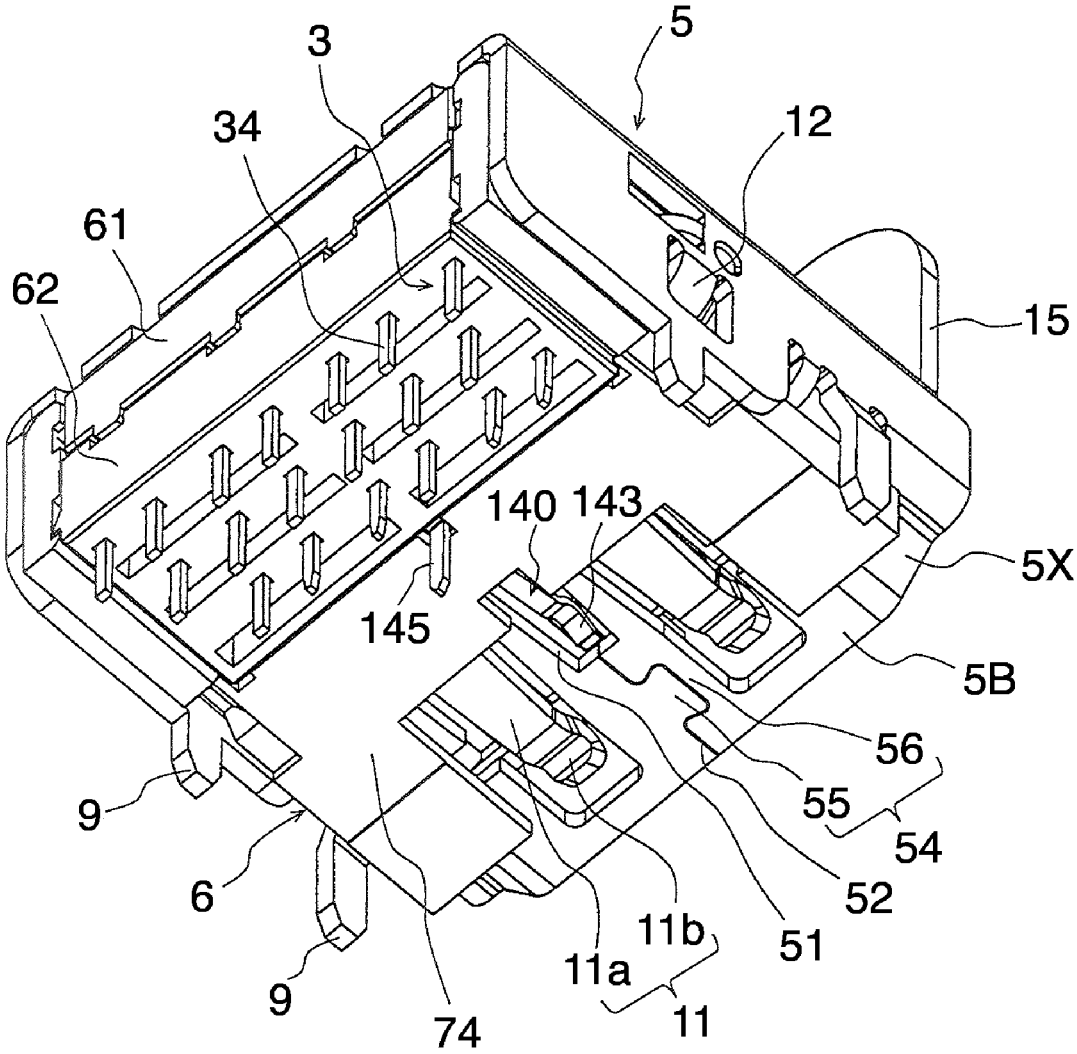
FIG. 9 is a perspective view from the bottom surface side of the receptacle shown in FIG. 7.
Figure 10:
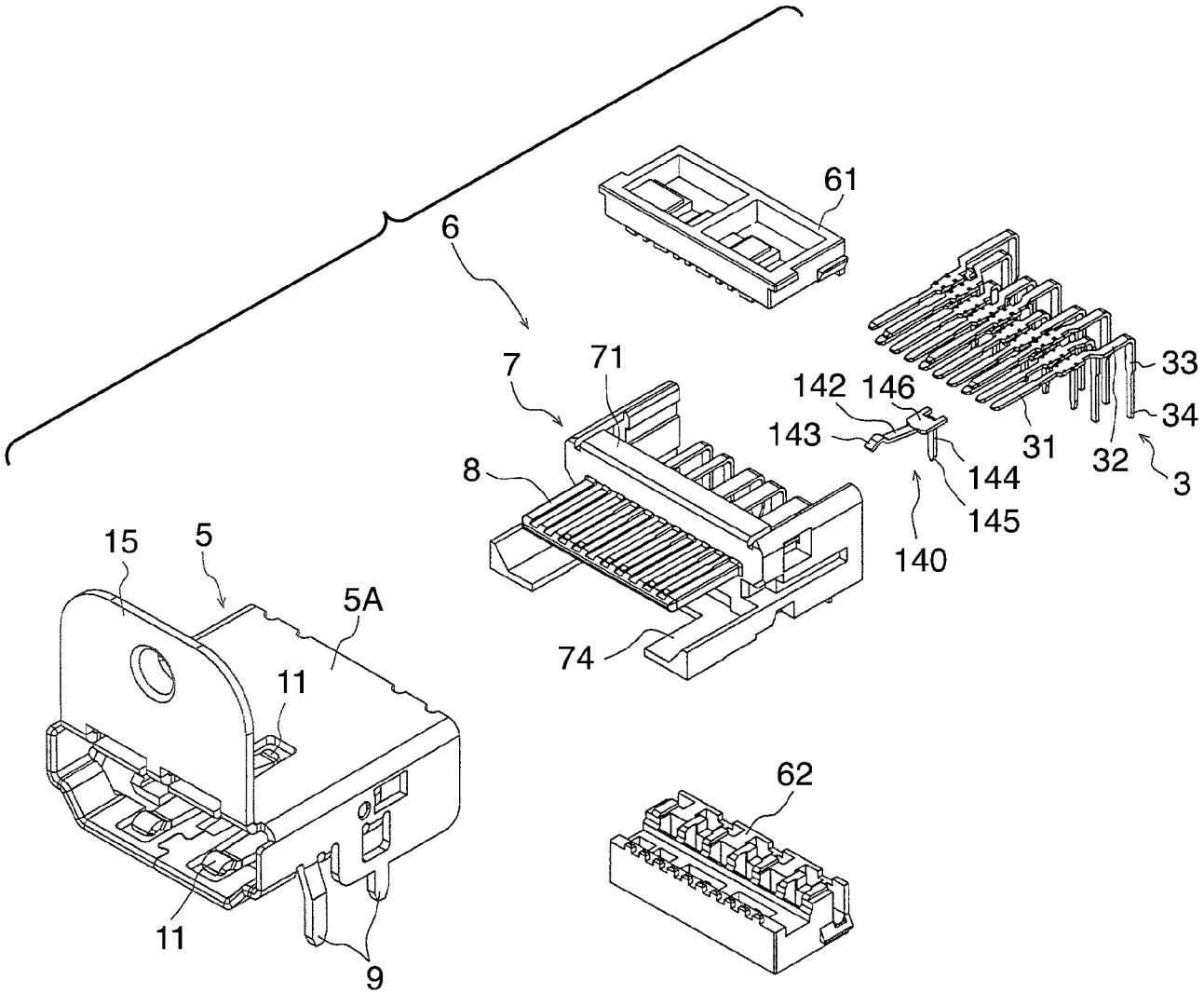
FIG. 10 is an exploded view of the receptacle shown in FIG. 7.
Figure 12:
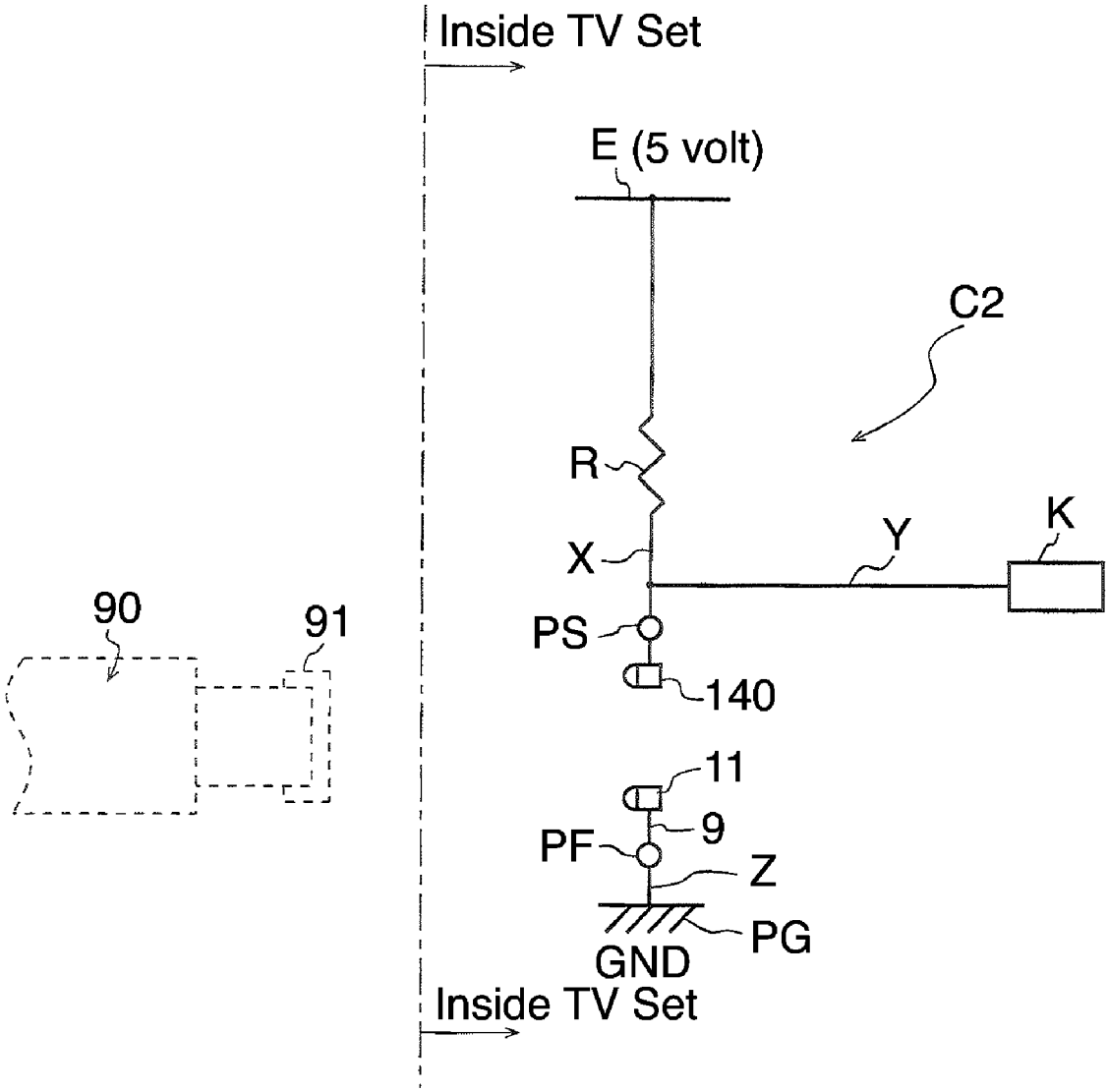
FIG. 12 serves to explain the mounting structure of the receptacle shown in FIG. 7, this being a schematic drawing of an electric circuit provided at the circuit board for detecting whether the plug has been mated with the receptacle.
Figure 13:
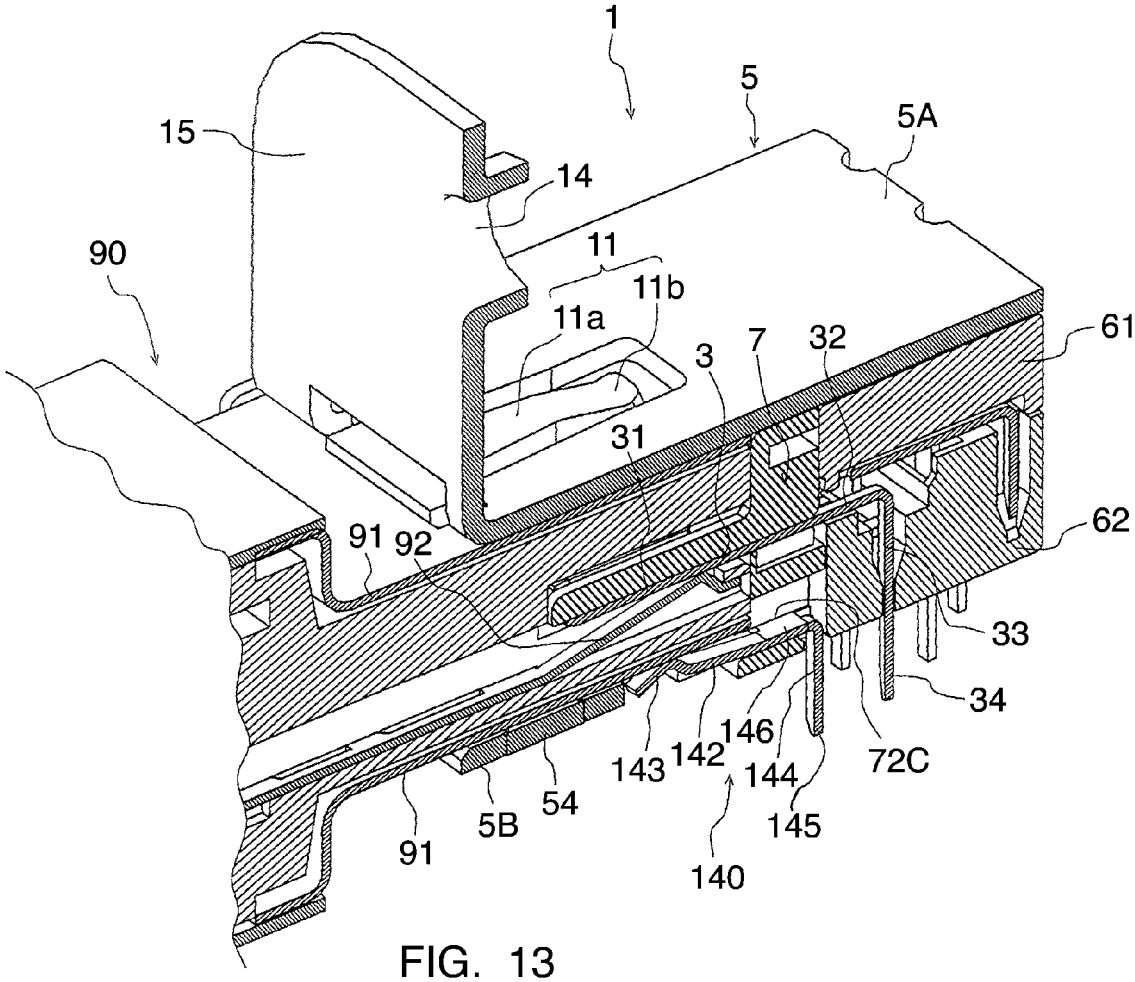
FIG. 13 is a perspective vertical sectional view illustrating how the plug is inserted into the receptacle shown in FIG. 7.

In FIG. 7, FIG. 8, and FIG. 9, the reference numeral 1 stands for the receptacle, 2—the plug insertion port, 5—the receptacle shell made of a sheet metal, 5X—the tubular portion of the shell 5, 6—the receptacle body, 9—the installation leg, 7—the molding portion, 71—the base portion, and 80—the space for receiving the plug. The installation leg 9 is soldered, as shown in FIG. 12, to the conductor pattern PF provided on a circuit board. The conductor pattern PF is connected via the ground line Z to the GND pattern PG provided at the circuit board. Further, as shown in FIG. 13, the plug 90 that is being inserted through the plug insertion port 2 from the horizontal direction is received in the space 80. The plug 90 comprises a plug shell 91 (as shown in FIGS. 12,13) made of a metal.

In FIG. 7, FIG. 8, and FIG. 13, the reference numeral 11 stands for spring portions provided in the shell 5. Each spring portion 11 is composed of an arm portion 11*a* formed as a cantilever at the shell 5 and a contact portion 11*b* that is formed at the distal end of the arm portion 11*a* and protrudes from the inner surface of the shell 5 toward a terminal table 8. The spring portions are provided at the upper surface portion 5A and a bottom surface portion 5B of the shell 5 so as to sandwich the terminal table 8 from above and below. The spring portion 11 of the upper surface portion 6A extends from the front side toward the interior in the plug insertion direction, and the spring portion 11 of the bottom surface portion 5B extends from the interior toward the front side in the plug insertion direction.

The spring portions 11 serve to clamp, by the elastic forces thereof, the plug 90 received in the space 80 and have a function of coming into contact with a plug shell 91 when the plug 90 is received in the space 80, forming a circuit composed of the plug shell 91, the spring portion 11, the receptacle shell 5, installation leg 9, and the GND pattern PG of the circuit board (see FIG. 12), and grounding the plug shell 91 and receptacle shell 5.

As shown in FIG. 8 and FIG. 13, the detection contact 140 is installed at the receptacle body 6 in a state in which the detection contact does not come into contact with the shell 5. A lead portion 145 that is soldered to the conductor pattern PS (see FIG. 12) for sensing and detecting the connection of the circuit board is formed on one end of the detection contact 140, and a contact portion 143 that will come into contact with the plug shell 91 of the plug 90 inserted into the plug insertion port 2 is formed on the other end of the detection contact. A power source line X provided at the circuit board is connected to the conductor pattern PS.

The detection contact 140 is composed of a wide portion 146 that is inserted into and locked by an insertion hole 72C formed in the base portion 71*m*, an arm portion 142 extending from the wide portion 146 in the direction of the plug insertion port 2, a contact portion 143 provided at the distal end of the arm portion 142, a leg portion 144 bent at an almost right angle from the wide portion 146, and a lead portion 145 formed at the distal end of the leg portion 144. The lead portion 145 passes through an installation hole provided in the circuit board and is soldered to the conductor pattern PS (see FIG. 12) provided at the backside of the circuit board. As described below, the pattern PS is connected to the power source line X.

The contact portion 143 comes into contact with the plug shell 91 of the inserted plug 90. Thus, the contact portion 143 is disposed so as to face the backside surface of the terminal table 8 and, as shown in FIG. 13, comes into contact with the plug shell 91 when a terminal 92 provided at the plug 90 is connected to the terminal 3 of the receptacle 1.

Figure 11:
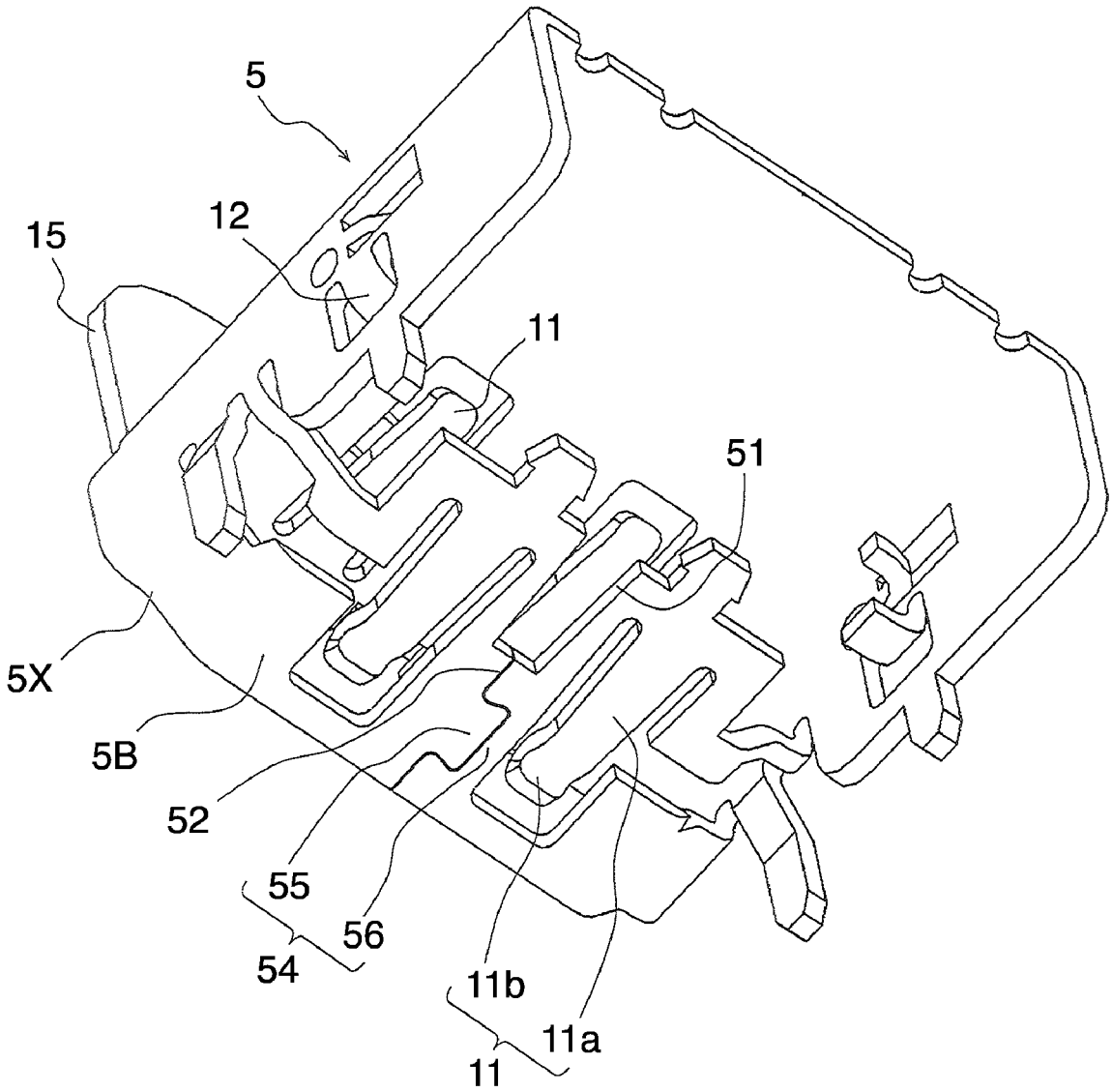
FIG. 11 is a perspective view from the bottom surface side showing only the receptacle shell of the receptacle shown in FIG. 7.

As shown in FIG. 8, FIG. 9, and FIG. 11, the contact portion 143 and arm portion 142 are disposed inward of a cut-out portion 51 formed in the receptacle shell 5, at a distance from the inner edge of the cut-out portion 51.

The cut-out portion 51 is formed in a tubular portion 5X of the receptacle shell 5. More specifically, the shell 5 has the tubular portion 5X obtained by forming a metal sheet into a tube, and the tubular portion 5X is formed by engaging a convex portion 55 formed on one end of the metal sheet with a concave portion 56 formed on the other end. These convex portion 55 and concave portion 56 constitute a joint portion 54 portion which joins one end of the metal sheet to the other end. The cut-out portion 51 is positioned on an abutment line 52 of these both ends of the metal sheet further in the insertion direction of the plug 90 from the joint portion 54 and is formed by cutting to the rear end of the tubular portion 5X with the left-right symmetry with respect to the abutment line 52.

The contact portion 143 of the detection contact 140 protrudes in a free state thereof from the inner surface of the receptacle shell 5 toward the terminal table 8, and when this contact portion 143 comes into contact with the shell 91 of the plug 90 that is being advanced into the space 80 and the arm portion 142 is bent, the contact portion 143 is displaced inside the cut-out portion 51, without touching the shell 5. Thus, the spacing between the peripheral edges of the contact portion 143 and arm portion 142 and the inner edge of the cut-out portion 51 is set to a predetermined value such that when the contact portion 143 comes into contact with the shell 91 of the plug 90 and the arm portion 142 is bent, the contact portion 143 and arm portion 142 can be displaced inside the cut-out portion 51, without coming into contact with the shell 5.

In other words, the detection contact 140 is forcedly inserted into and held by the base portion 71 of the molding portion 7, faces the cut-out portion 51, and is insulated, similarly to the terminals 3, from the receptacle shell 5.

Further, the leg portion 144 and lead portion 145 of the detection contact 140 are parallel to the leg portion 33 and lead portion 34 of the terminal 3 and are soldered in this state to the conductor pattern of the circuit board that has been prepared immediately therebelow. As a result, it is not necessary to form a complex conductor pattern. Further, because the detection contact 140 and the terminals 3 are spaced, the conductor pattern of the detection contact 140 does not require changing the conductor pattern of terminals 3.

Further, in the circuit board onto which the receptacle 1 is mounted, an electric circuit C2 (see FIG. 12) is provided to detect that the predetermined voltage (5 V) applied to the detection contact 140 changes to 0 V when the plug 90 comes into contact with the detection contact 140. The electric circuit C2 is installed, for example, inside the TV set.

Referring to FIG. 12, the reference symbol X stands for the electric power line connected to the power source E (5 V), PS—the conductor pattern connected to the power line X, 140—the detection contact soldered to the conductor pattern PS, 11—the spring portions provided at the receptacle shell 5, 9—the installation leg formed on the shell 5, PF—the conductor pattern to which the installation leg 9 is soldered, R—the resistor for applying the voltage of the power source E to the detection contact 140, Y—the detection line for detecting the voltage on the detection contact 140, K—the detector for detecting the voltage on the detection line Y, Z—the ground line connected by one end thereof to the conductor pattern PF and by other end thereof to the GND pattern PG of the circuit board, 90—the plug, and 91—the plug shell.

The operation of the present embodiment will be described below.

With the receptacle 1, the connection of the plug 90 can be reliably detected as described below.

As shown in FIG. 8 and FIG. 12, in a state in which the plug 90 is not inserted into the receptacle 1, the detection contact 140 and the spring portions 11 are electrically cut off. Therefore, a voltage (5 V) of the power source E is applied to the detection line Y, and the detector K detects 5 V (High).

As shown in FIG. 12 and FIG. 13, when the plug 90 is inserted into the receptacle 1, the plug shell 91 comes into contact with the detection contact 140 and the spring portions 11, electrically connecting them. Therefore, the detection contact 140 and the detection line Y are grounded and the detector K detects almost 0 V (Low).

Thus, where the plug 90 is inserted into the receptacle 1, an electric current flows through the detection contact 140 and the spring portions 11 via the plug shell 91. Therefore, the detection contact 140, the plug shell 91, the spring portions 11, and the installation leg 9 are electrically grounded. As a result, the voltage (5 V) of the power source E that has been heretofore applied to the detection contact 140, is grounded to the GND pattern PG via the installation leg 9, the conductive pattern PF, and the ground line Z, and the detector K detects almost 0 V.

Thus, whether the plug 90 has been inserted into the receptacle 1 can be detected based on the variation of the voltage detected by the detector K.

As shown in FIG. 8, the detection contact 140 of the present embodiment is disposed deeper in the insertion direction of the plug 90 than the concave portion 56 and convex portion 55 (joint portion 54) of the receptacle shell 5 that define the space 80 for receiving the plug 90 and the detection contact 140 faces the backside surface of the terminal table 8. Therefore, as shown in FIG. 13, when the plug 90 is inserted deep into the space 80 and the terminal 92 of the plug 90 comes into contact with the terminal 3 of the terminal table 8, the contact portion 143 of the detection contact 140 comes into contact with the plug shell 91, the voltage detected by the detector K switches from 5 V (High) to 0 V (Low), and the connection of the plug 90 and receptacle 1 can be detected with high reliability.

In order to detect the mating of the plug 90 and the receptacle 1 in such manner, the receptacle 1 is changed only by forming the cut-out portion 51 in the bottom surface portion 5B of the receptacle shell 5 and incorporating the detection contact 140 in the molding portion 7, whereas the essential components of the receptacle 1, that is, the main components whose arrangement and dimensions are restricted by the HDMI standard (location of terminals 3, and the like), are not changed at all. Therefore, absolutely no changes are required to be introduced in the plug 90.

Explaining in greater detail, the cut-out portion 51 is obtained by cutting out a very small part of the bottom surface portion 5B of the receptacle shell 5, this part having a left-right symmetry with respect to the abutment line 52 of the bottom surface portion 5B. Therefore, no changes are needed for the arrangement of terminals 3 or for the shape of the plug-receiving space 80 or plug insertion port 2, and absolutely no effect is produced on the mating of plug 90.

As a result, the present invention can be easily applied to the receptacle 1 and plug 90 in which the arrangement of terminals 3 or the shape and dimensions of the plug insertion space 80 or plug insertion port 2 are strictly determined by a standard, more specifically, to the receptacle 1 and plug 90 conforming to the HDMI standard.

Further, the cut-out portion 51 is provided in a deep position where interference with the joint portion 54 is avoided, that is, provided by cutting out a small portion on the opposite side from the plug insertion port 2. Therefore, the strength and rigidity of the receptacle shell 5 and the electromagnetic shielding ability of the receptacle shell 5 are not lost.

In addition, because the cut-out portion 51 is formed by cutting down to the rear end of the bottom surface portion 5B of the receptacle shell 5, when the detection contact 140 is positioned in the direction from the rear end side toward the plug insertion port 2, the detection contact 140 can be easily incorporated, without any obstacles, and there is no need to be concerned about short circuiting or the like.

Further, as shown in FIG. 7 and FIG. 9, a bottom plate portion 74 that extends so as to be hidden below the bottom surface portion 5B of the receptacle shell 5 is provided at the lower end of the base portion 71 of the modeling portion 7. Therefore, where the receptacle 1 is mounted on the circuit board, the receptacle shell 5 is spaced from the circuit board at a distance of the thickness of the bottom plate portion 74, and it is not necessary to provide a special clearance (a clearance between the detection contact 140 and the circuit board) for the displacement of the detection contact 140.

Moreover, because the leg portion 144 and lead portion 145 of the detection contact 140 are disposed almost parallel to the leg portion 33 and lead portion 34 of the terminal 3, no unnecessary spread occurs in the conductor pattern provided on the circuit board. Further, because the leg portions 33, 144 are at a sufficient distance from each other, the probability of bridging during soldering to the circuit board is low and the mounting operability is not lost.

As shown in FIG. 12, the circuit board is changed to apply a voltage of the power source E to the detection contact 140 in order to detect the mating of the plug 90 and the receptacle 1. Therefore, it is suffice to provide additionally the circuit board only with the power line X that is connected by one end to the power source E and by the other end to the detection contact 140 and provided with a resistance R, the detection line Y connected to the line X, the detector K connected to the detection line Y, the conductor pattern PS provided at the power source line X for soldering the detection contact 140, the conductor pattern PF for soldering the installation leg 9, and the ground line Z that is connected by one end thereof to the conductor pattern PF and by the other end to the GND pattern PG, and this addition can be made a low cost. The power source E and GND pattern PG are provided on the original circuit substrate.

In the present embodiment, the detection contact 140 is forcedly inserted into the insertion hole 72C, but such configuration is not limiting. For example, after has been insertion molded in an insulation part, this part may be incorporated in the molding portion 7.

Modification examples that are shared by the embodiment shown in FIG. 1 to FIG. 6 and the embodiment shown in FIG. 7 to FIG. 14 will be explained below.

The receptacle 1 of all the above-described embodiments is explained with reference to an example of a dipping system as a system for mounting on a circuit board, but it goes without saying that the surface mounting system may be also employed.

Further, the receptacle 1 of all the embodiments may be also mounted on a circuit board in the direction perpendicular to the plug insertion direction.

Figure 14:
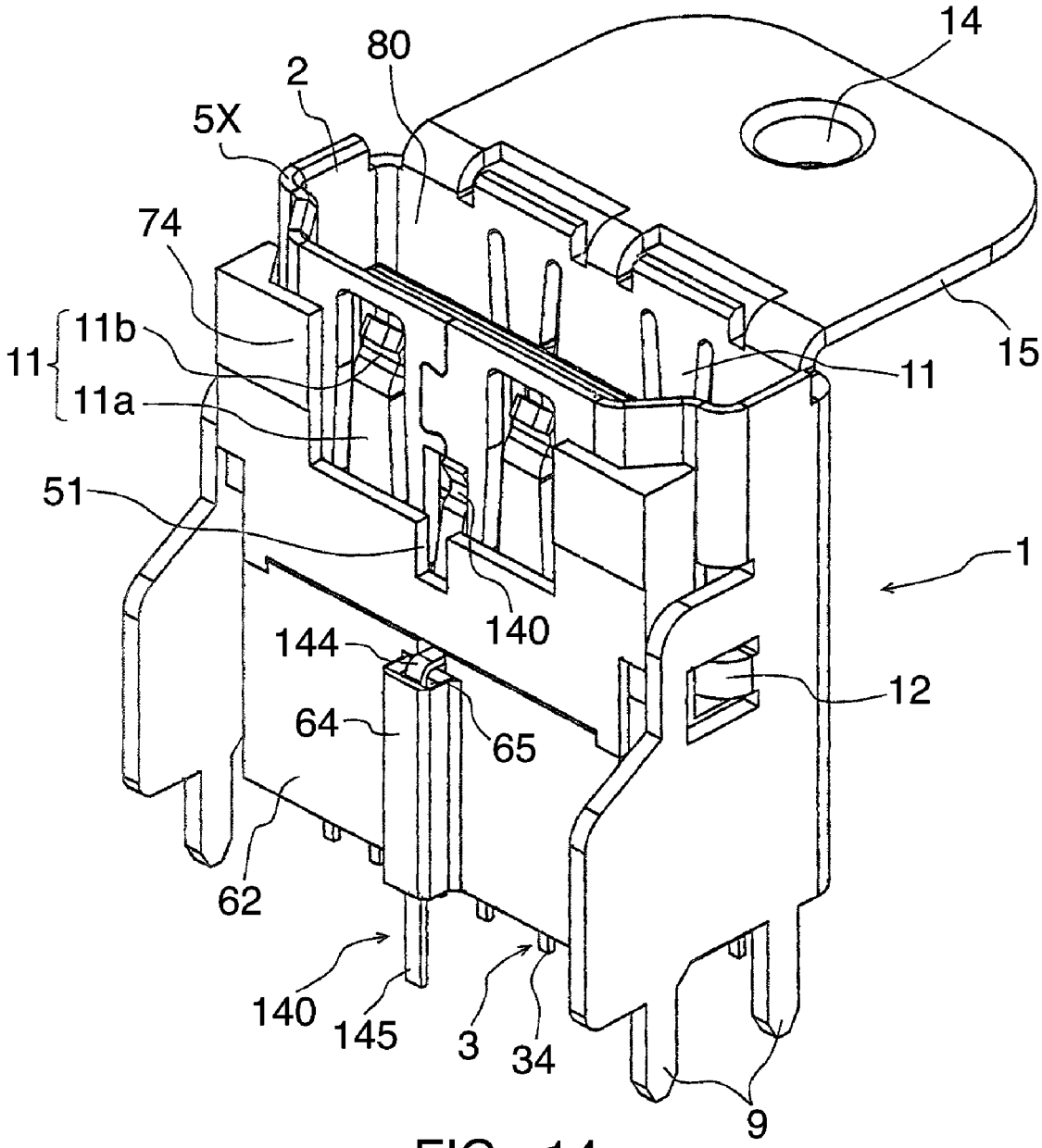
FIG. 14 is a perspective view of a receptacle of a vertical type illustrating a modified embodiment.
Figure 15:
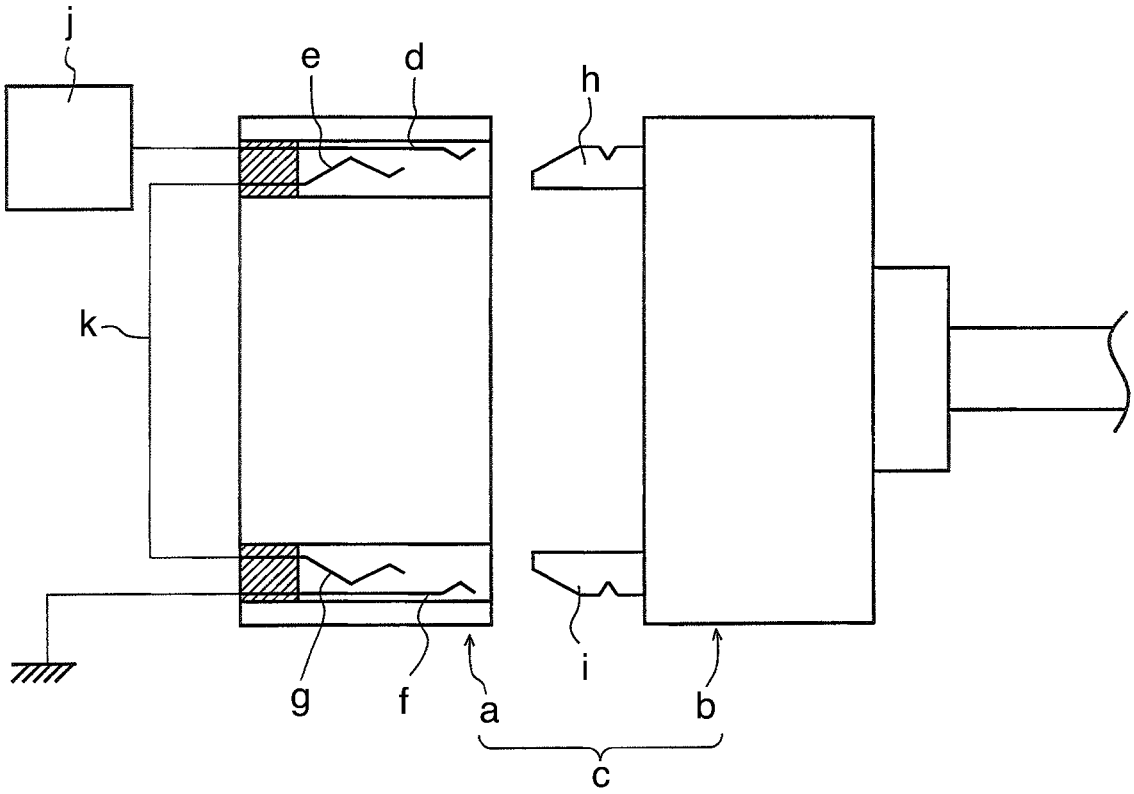
FIG. 15 is an explanatory drawing of a receptacle and a plug illustrating the conventional example.

More specifically, in the case of the embodiment shown in FIG. 1 to FIG. 6, a right surface portion (an abutment surface portion in the plug insertion direction) of the receptacle 1 shown in FIG. 4 serves as a surface for mounting on a circuit board (see FIG. 14). In this case, the leg portions 33 of the terminals 3, the leg portion 44A of the movable contact 40A, and the leg portion 44B of the immovable contact 40B are formed into a straight shape, without bending at a right angle, and protrude from the right surface portion of the receptacle 1 shown in FIG. 4.

In the case of the embodiment shown in FIG. 7 to FIG. 14, the leg portions 33 of the terminals 3 are extended linearly and rearwardly, and the leg portion 144 of the detection contact 140 is bent through 90 degrees with respect to the base portion 146 and then bent through 90 degrees in the opposite direction and extended linearly and rearwardly as shown in FIG. 14. Such leg portion 144 of the detection contact 140 is inserted through a hole 65 formed in an insulation box 64 provided at the lower block 62.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A structure in which a receptacle that can detect the insertion and extraction of a plug is mounted on a circuit board, the structure comprising:

a receptacle shell having formed therein a plug insertion port into which said plug is inserted and from which said plug is extracted;

a receptacle body provided inside said receptacle shell;

a movable contact that is installed at a base portion of said receptacle body, said base portion faces a distal end of said plug when said plug is inserted into said plug insertion port, and that is deformed elastically when pushed by said plug inserted; and an immovable contact that is installed at said base portion, is normally spaced from said movable contact, and comes into contact with said movable contact when said movable contact is pushed by said plug and elastically deformed;

wherein an electric circuit for detecting that said movable contact and said immovable contact are in contact with each or separated from each other is provided at said circuit board; and said electric circuit has an electric power line connected to one of said movable contact and said immovable contact, a ground line connected to the other of said movable contact and said immovable contact, and a detection line that is connected to said movable contact or said immovable contact and serves to detect a voltage.

2. The receptacle according to claim 1, wherein said base portion having an accommodation portion which is formed in said base portion by hollowing in said base portion in the insertion direction of said plug; and said movable contact and said immovable contact are installed in said accommodation portion.

3. A structure in which a receptacle that can detect the insertion and extraction of a plug is mounted on a circuit board, the structure comprising:

a receptacle shell having formed therein a plug insertion port into which said plug is inserted and from which said plug is extracted;

a receptacle body provided inside said receptacle shell;

a movable contact that is installed at a base portion of said receptacle body, said base portion faces a distal end of said plug when said plug is inserted into said plug insertion port, and that is deformed elastically when pushed by said plug inserted; and an immovable contact that is installed at said base portion, is normally in contact with said movable contact, and separated from said movable contact when said movable contact is pushed by said plug and elastically deformed;

wherein an electric circuit for detecting that said movable contact and said immovable contact are in contact with each or separated from each other is provided at said circuit board; and said electric circuit has an electric power line connected to one of said movable contact and said immovable contact, a ground line connected to the other of said movable contact and said immovable contact, and a detection line that is connected to said movable contact or said immovable contact and serves to detect a voltage.

4. The receptacle according to claim 3, wherein said base portion having an accommodation portion which is formed in said base portion by hollowing in said base portion in the insertion direction of said plug; and said movable contact and said immovable contact are installed in said accommodation portion.

5. A structure in which a receptacle that detects the insertion and extraction of a plug having a plug shell made of a metal is mounted on a circuit board, wherein said receptacle comprises:

a receptacle shell made of a metal and having formed therein a plug insertion port into which said plug is inserted and from which said plug is extracted;

a receptacle body provided inside said receptacle shell;

an installation leg formed on said receptacle shell;

a spring portion formed on said receptacle shell and coming into contact with said plug shell when said plug is inserted into the plug insertion port; and a detection contact that is installed at said receptacle body, insulated from said receptacle shell, has a lead portion that is conductively connected to said circuit board, and has a contact portion that comes into contact with said plug shell of said plug inserted into said plug insertion port, and said circuit board comprises:

a ground line to which said installation leg is soldered;

an electric power line to which a lead portion of said detection contact is soldered; and a detection line that detects a variation of a voltage applied to said detection contact when said plug is inserted into said plug insertion port and electric conduction is established between said contact portion of said detection contact and said spring portion of said receptacle shell by said plug shell.

6. The mounting structure of the receptacle according to claim 5, wherein said receptacle body has a terminal table that is formed to extend toward said plug insertion port inside said receptacle shell, and said contact portion of said detection contact is disposed opposite said terminal table and formed to protrude further to the side of said terminal table from an inner surface of said receptacle shell.

7. The mounting structure of the receptacle according to claim 5, wherein said receptacle shell is formed into a tubular shape by the engagement of a convex portion formed on one end of a metal sheet and a concave portion formed on the other end of said metal sheet, a cut-out portion is provided on an abutment line of said receptacle shell, said cut-out portion being positioned deeper in said plug insertion direction than said convex portion and said concave portion and being cut symmetrically with respect to said abutment line, and said contact portion of said detection contact is disposed inward of the cut-out portion, spaced from an inner edge of the cut-out portion.

* * * * *